United States Patent [19]

Krauss

[11] Patent Number: 4,671,030

[45] Date of Patent: Jun. 9, 1987

[54] BULK SILO WITH AERATED MIXING OR HOMOGENIZING CHAMBER

[75] Inventor: Werner Krauss, Hamburg, Fed. Rep. of Germany

[73] Assignee: Claudius Peters AG, Fed. Rep. of Germany

[21] Appl. No.: 836,747

[22] Filed: Mar. 6, 1986

[30] Foreign Application Priority Data

Apr. 3, 1985 [DE] Fed. Rep. of Germany ..... 3512289

[51] Int. Cl.[4] ..... E04H 7/00

[52] U.S. Cl. ..... 52/197; 52/192; 222/564; 414/304

[58] Field of Search ..... 52/192, 197; 414/304, 414/309, 310; 222/154, 547, 564

[56] References Cited

U.S. PATENT DOCUMENTS

| | | | |
|---|---|---|---|
| 1,758,662 | 5/1930 | Heath | 52/197 |
| 3,490,655 | 1/1970 | Ledgett | 222/564 X |
| 4,138,021 | 2/1979 | McKenzie | 222/564 X |
| 4,146,145 | 3/1979 | Easton | 414/310 X |
| 4,382,723 | 5/1983 | Möller | 222/564 X |
| 4,548,342 | 10/1985 | Fisher | 222/564 X |
| 4,566,232 | 1/1986 | Klein-Albenhausen | 52/197 X |

FOREIGN PATENT DOCUMENTS

| | | | |
|---|---|---|---|
| 2133189 | 1/1973 | Fed. Rep. of Germany | 52/192 |
| 2727499 | 12/1978 | Fed. Rep. of Germany | 52/192 |
| 2379968 | 10/1978 | France | 414/310 |
| 657158 | 10/1963 | Italy | 52/197 |

*Primary Examiner*—William F. Pate, III
*Assistant Examiner*—Creighton Smith
*Attorney, Agent, or Firm*—Eric P. Schellin

[57] ABSTRACT

Bulk silo with essentially centrally located aerated mixing or homogenizing chamber whose wall comprises a plurality of permanent passage openings for the material from the main silo area and is connected to an inspection area. In order to improve inspection and service, the inspection area is formed by a hollow column which is accessible from below, is located inside the chamber and comprises observation openings into the chamber as well as comprising the vent line.

10 Claims, 1 Drawing Figure

BULK SILO WITH AERATED MIXING OR HOMOGENIZING CHAMBER

BACKGROUND OF THE INVENTION

The invention relates to a bulk silo with centrally located aerated mixing or homogenizing chamber whose wall contains a plurality of constantly open passage openings for the material from the main silo area and which is connected to an inspection area.

It is known in a silo of the named type (DE-AS No. 27 27 499) that the operational safety in the case of sensitive material which tends to interruptions of flow can be improved by building a ring-shaped observation walk around the chamber, that is, within the main silo area, whose wall contains inspection openings for observing both the passage openings and the empty chamber bottom. However, such a walk is extremely expensive, because its length is as long as the circumference of the chamber, its wall must be dimensioned to withstand the pressure prevailing in the main silo area and because an access passage must be created from the outside to the walk.

It is also known ( DE-AS No. 21 33 189) that a discharge passage running from the silo center to the silo circumference can be connected to a separate observation passage which contains inspection openings to the discharge passage and is accessible from the outside in such a manner that the observation passage accompanies the discharge passage over its entire length. This arrangement can not be used if a central discharge chamber is provided in the silo; it corresponds, however, to the previously explained arrangement for a central chamber in which a passage runs from the outside to the chamber circumference, which is surrounded over its entire length by an observation walk. It is particularly also not apparent therefrom how the expense of inspecting a silo with a central discharge chamber could be reduced.

Another disadvantage of the known arrangements is the fact that during operation an observation is possible only to a limited extent, while servicing is not possible at all. For servicing, the silo discharge must be stopped and the chamber emptied.

The invention has the task of creating a bulk silo of the type initially cited which makes possible for a better observation and a better servicing of the chamber and of the associated emptying device at a low cost.

BRIEF DESCRIPTION OF THE INVENTION

The invention solves this task as follows: The inspection area is formed by a hollow column which can be accessed from below, is located within the chamber and which contains observation openings to the chamber as well as containing the aeration line.

The fact that the hollow column is located inside the chamber makes the construction cost required for it considerably less than that for an inspection walk provided outside the chamber and provided with an access passage. The hollow column also braces the chamber ceiling, so that the chamber wall carries a lesser load and can therefore be made weaker. Finally, the hollow column can receive the aeration line, the guiding of which often poses problems. And in conclusion, forming the inspection area as a vertical column offers the possibility of extending the inspection are above the material level which occurs in the chamber during operation, so that it is possible even during operation to observe from this vantage point the operation of the chamber itself as well as of the passage openings from the main silo area to the chamber as well as of the discharge devices provided in the chamber.

If this result is compared with the state of the art, it is evident that observation and servicing are improved, that the construction of the observation area as such is less expensive and that, in addition, it constitutes a constructional advance as regards the execution of the chamber and of the aeration line, which also reduce the cost.

These advantages are best achieved by a central hollow column located vertically in the chamber. However, a more or less off-center arrangement of the hollow column in relation to the chamber is not excluded.

In addition to the observation openings of the hollow column located above the material level, it is advantageous to provide service openings near the bottom in such a manner that they are located approximately opposite the passage openings. This should make it possible to service the passage openings, e.g. by poking. The feature that the service openings should be located approximately opposite the passage openings is explained in this connection by the fact that the passage openings are accessible from the service openings to suitable tools such as poker bars without having to enter the actual chamber. This also permits the possibility of servicing when the chamber is not completely empty or even (especially on the side opposite the trouble spot) if it is being operated in a choked manner.

However, the chamber should also be accessible from the hollow column so that more extensive service can also be performed in the chamber area after the discharge operation has been stopped.

In order that the discharge devices of the chamber can also be serviced during operation, they are located with advantage in the hollow column, whereby a further feature of the invention provides that several, preferably two discharge devices distributed around the circumference of the hollow column are provided, so that if there is trouble in one discharge device, the other one can continue to be operated during service. It can also be advantageous to provide discharge devices which can be operated directly from the bottom of the main silo area, circumventing the chamber, so that the silo operation does not have to cease entirely if service must be performed in the chamber which can not be performed during the operation of the inspection or service openings.

According to another feature the hollow column can contain at least one inspection opening leading into the main silo area, whereby this opening is located with advantage laterally on a part of the hollow column which extends past the chamber into the main silo area.

An embodiment can also be very advantageous in which the hollow column is positioned not vertically but runs essentially horizontally from the silo circumference to the upper area of the chamber and comprises at least one inspection opening there.

DETAILED DESCRIPTION OF THE INVENTION

Figure 1:
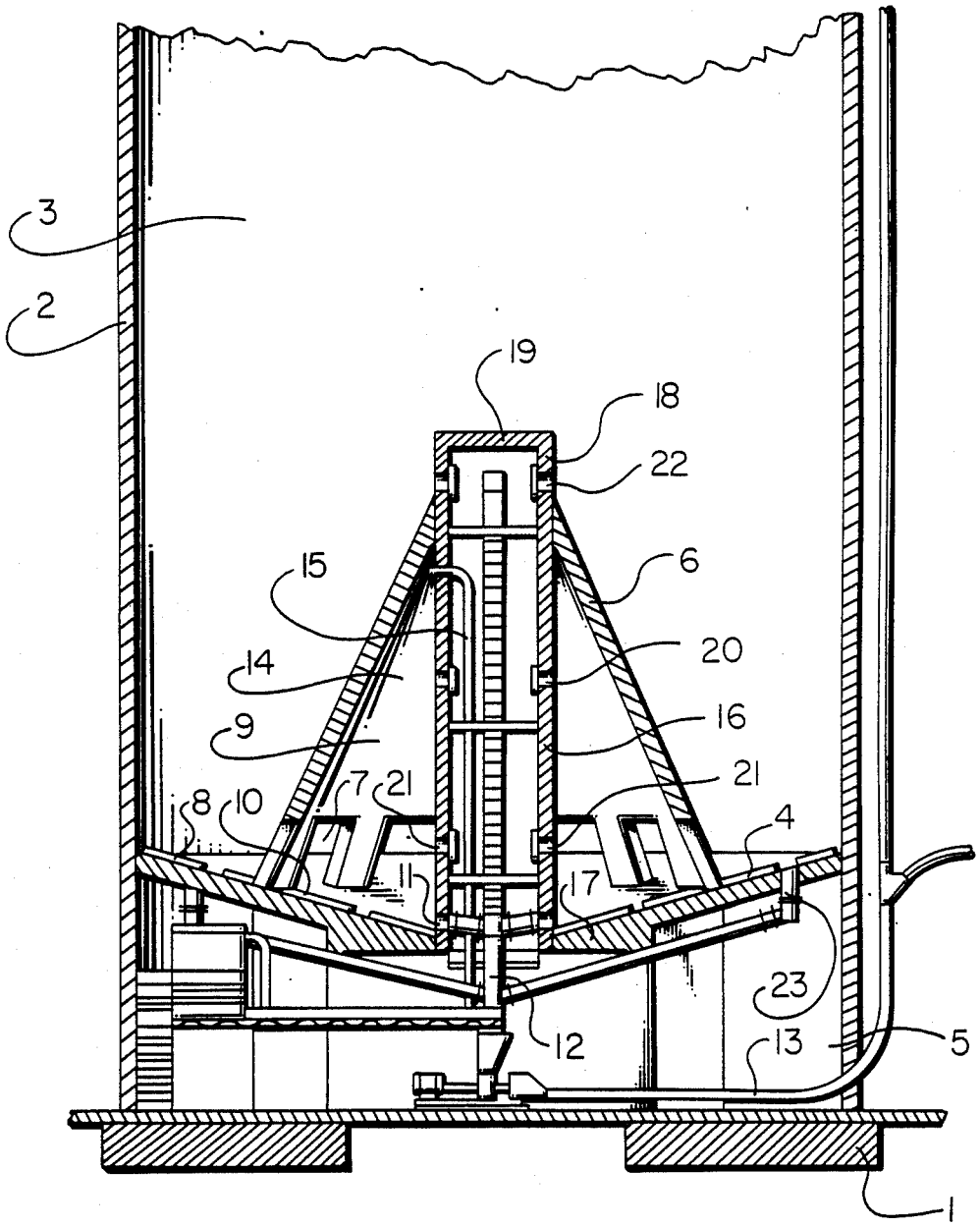

The invention is explained in more detail in the following with reference made to the drawing, which shows an advantageous embodiment in a vertical section.

Silo body 2 resting via foundations 1 on the ground contains main silo area 3, under bottom 4 of which accessible lower silo area 5 is formed. Mixing chamber 6 of a known conical construction is provided in the middle of the cylindrical silo body on silo bottom 4. The wall of this mixing chamber comprises a plurality of passage openings 7 over bottom 4 through which the material can flow in a fluidized state from main silo area 3 into chamber 9 when aeration devices 8 located at the passage openings are loaded with compressed air. If the loading with compressed air of aeration device 8 in main silo area 3 is interrupted, the flow of material through openings 7 is also interrupted, so that chamber 9 can be emptied and entered.

The chamber itself comprises aeration devices 10 which allow the material to flow in through two discharge openings 11 which are connected via suitable discharge lines 12 to transport parts, in the example shown to pneumatic transport line 13.

Vent line 15 runs down from upper area 14 of chamber 9, which generally remains free during operation of rising material, to a device suitable for receiving the exhaust air, e.g. a part of the transport system. Within this known arrangement, hollow column 16 of the invention is vertically and centrally provided, which extends up cylindrically from bottom 17 of the chamber and reaches its wall 6 (its top in another embodiment) and even extends beyond it with its part 18 into main silo area 3, where it is closed by cover 19. It comprises observation openings 20 at a level which is normally above the level of the material in chamber area 9. Service openings 21 are provided at approximately the same level as passage openings 7. They can also be located somewhat higher than the passage openings. They should be located in such a manner that passage openings 7 and/or chamber bottom 17 can be reached from them, e.g. by poker bars, in order, for example, to eliminate solidifications. If these service openings 21 are too high to permit access into chamber 9, separate access openings can also be provided near chamber bottom 17. Finally, inspection openings 22 are comprised in the column wall above chamber 9 in the area of main silo area 3 through which the flowoff on the bottom of the main silo area can be inspected.

Work platform are provided under the opening.

Vent line 15 is run inside the hollow column and is therefore accessible. The same applies to the discharge devices runnin from discharge openings 11.

The silo of the invention is suitable, for example, for problem-prone materials such as fly ash. Its improved inspection and service qualities allow in many instances the elimination of expensive mechanical conveyors in the silo, which are otherwise often necessary for such material in order to render it conveyable.

The width of the access area in the hollow column should be large enough that work can also be performed with tools, e.g. poker bars, from it. The diameter should be on the order of 2 to 3 m, for example.

Discharge devices 23 run from bottom 4 of main silo area 3 which also run to conveyor 13 and permit the operation to be maintained if the silo discharge through the chamber is briefly halted for servicing the chamber or a passage opening or a discharge part.

What is claimed is:

1. In a bulk silo with an essentially centrally located aerated mixing or homogenizing chamber whose wall comprises a plurality of constantly open passage openings for the material from the main silo area and which is connected to an inspection area, the improvement wherein the inspection area is formed by a centrally located hollow column (16) which is accessible from below, is located inside a chamber (9) and comprises observation openings into the chamber (9) and a vent line (15) running from inside of said hollow column (16) into chamber (9).

2. Silo according to claim 1, wherein the hollow column is vertically formed.

3. Silo according to claim 2, wherein the observation openings (20) of the hollow column (16) are located at least in the upper chamber area (14) above the level of the material which develops during operation, and that all passage openings can be seen from them.

4. Silo according to claim 3, wherein the hollow column (16) comprises service openings (21) near the bottom approximately opposite the passage openings (7).

5. Silo according to claim 4, wherein the chamber (9) can be accessed from the hollow column (16).

6. Silo according to claim 5, wherein a silo discharge device (12) is located in the hollow column.

7. Silo according to claim 6, wherein at least two discharge devices distributed over the circumference of the hollow column are provided.

8. Silo according to claim 7, wherein at least one discharge device (23) from the main silo area outside the chamber (9) is provided.

9. Silo according to claim 8, wherein the hollow column (16) comprises at least one inspection opening (22) into the main silo area.

10. Silo according to claim 9, wherein the hollow column (16) extends beyond the chamber into the main silo area and that a plurality of laterally positioned inspection openings (22) are provided from which the silo bottom can be inspected.

* * * * *